US005392015A

United States Patent [19]

Matsuoka et al.

[11] Patent Number: 5,392,015

[45] Date of Patent: Feb. 21, 1995

[54] ELECTROMAGNETIC RELAY

[75] Inventors: Kazushige Matsuoka; Masato Kouzaki; Takashi Noguchi, all of Kyoto, Japan

[73] Assignee: Omron Corporation, Kyoto, Japan

[21] Appl. No.: 60,929

[22] Filed: May 13, 1993

[30] Foreign Application Priority Data

May 14, 1992 [JP] Japan ..... 4-121790

[51] Int. Cl.[6] ..... H01H 51/22

[52] U.S. Cl. ..... 335/78; 335/130

[58] Field of Search ..... 335/78–86, 335/124, 128, 130–133

[56] References Cited

U.S. PATENT DOCUMENTS 4,618,842 10/1986 Nestlen et al. ..... 335/128

4,958,137 9/1990 Schroeder ..... 335/80

*Primary Examiner*—Lincoln Donovan

*Attorney, Agent, or Firm*—Fish & Richardson

[57] ABSTRACT

An electromagnetic relay which is small in size, low in power consumption, high in productivity, and long in service life and which operates with high accuracy. The electromagnetic relay in which the electromagnet is energized and deenergized to swing its armature to drive a slide card, and a movable contact piece forming a contact mechanism is swung by the card, wherein a small gap is formed between the movable contact piece and a part of an end of the card, when the card is returned.

14 Claims, 5 Drawing Sheets

FIG. 2(b)
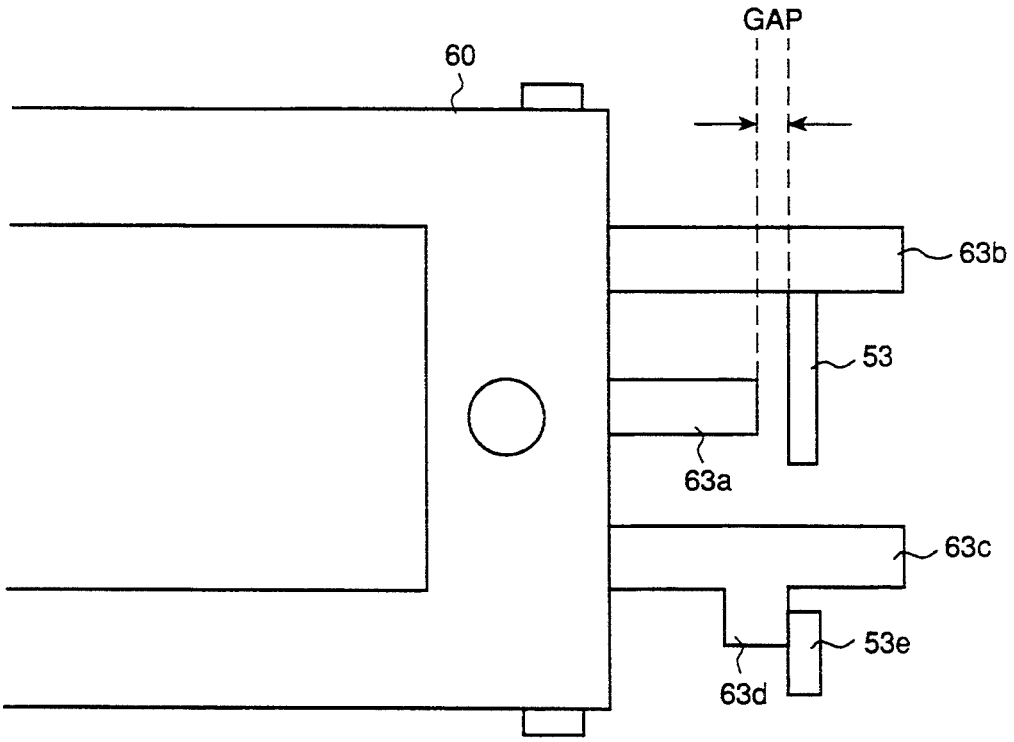
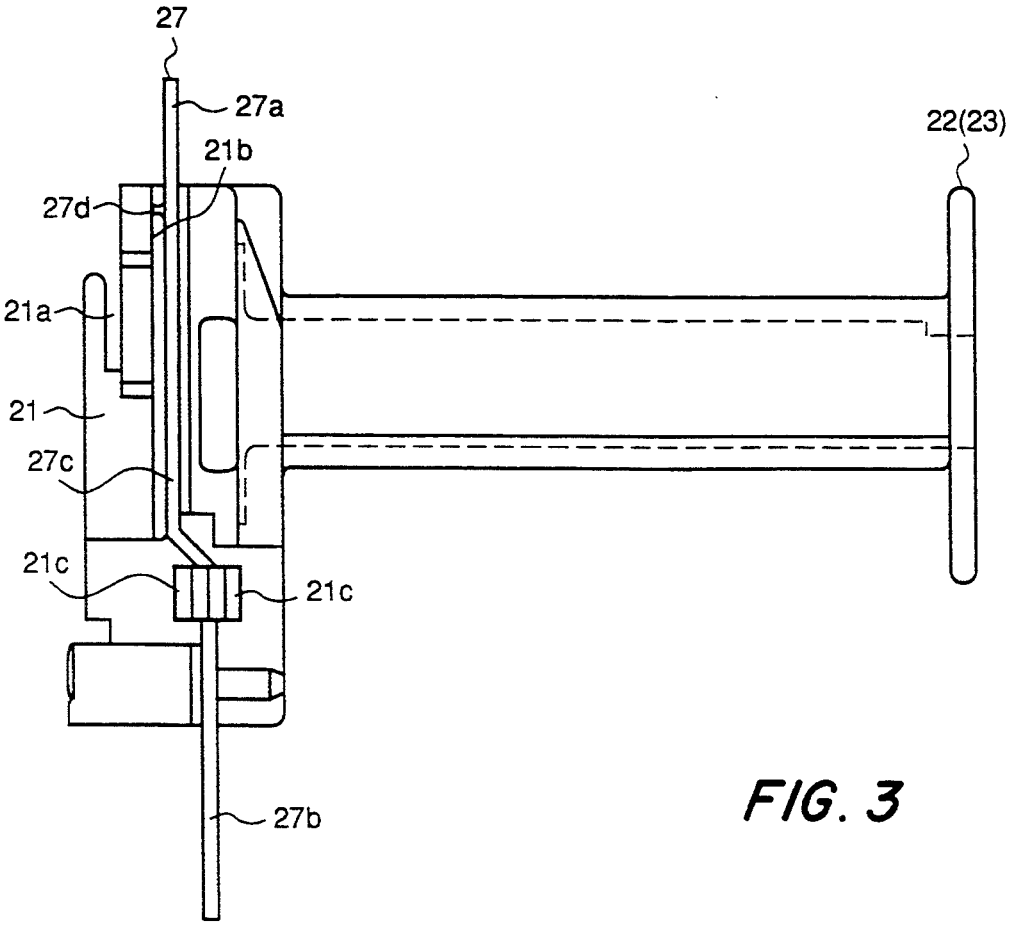
FIG. 3

FIG. 4
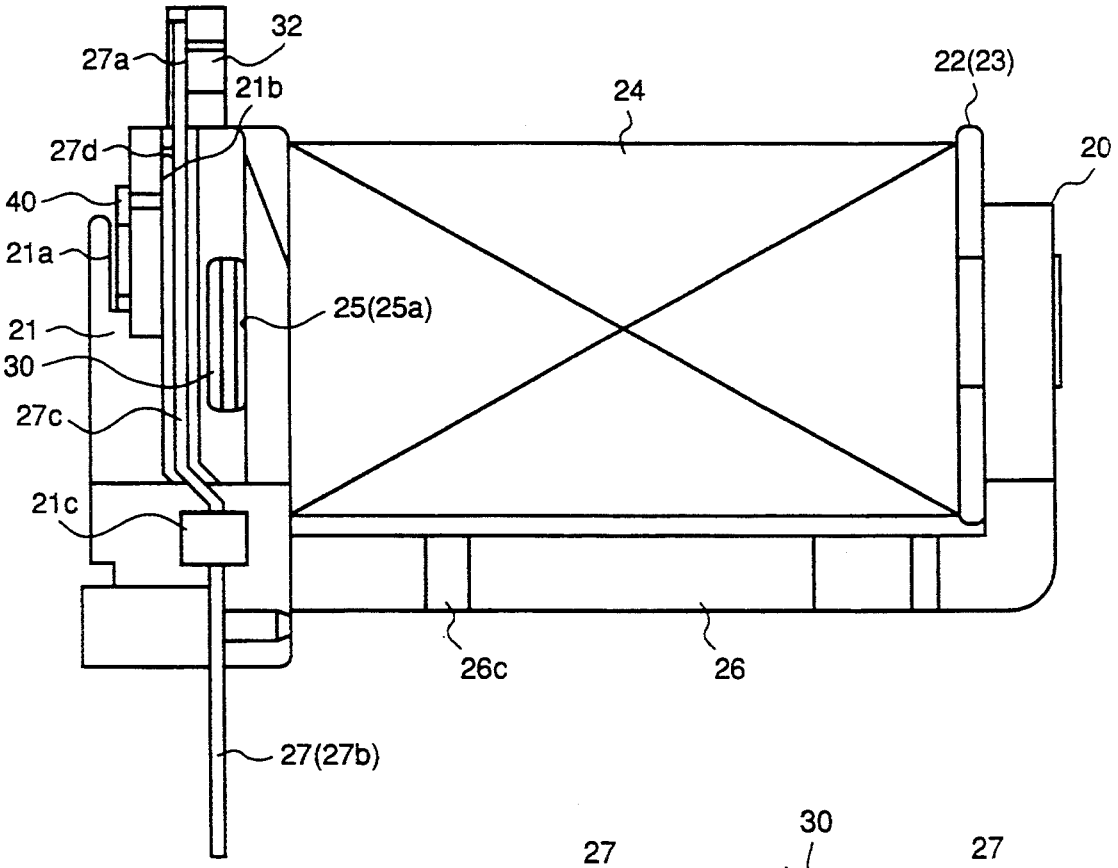
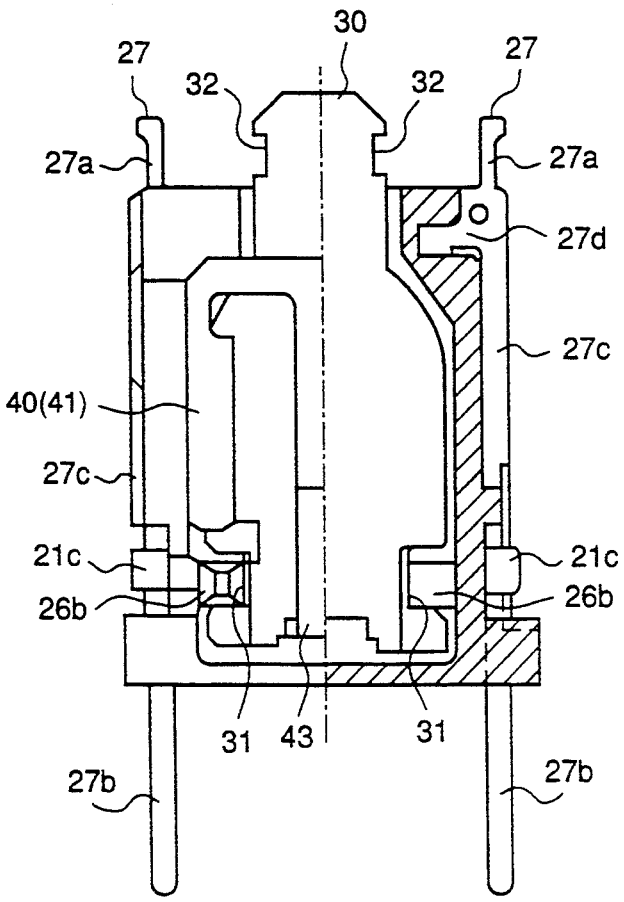
FIG. 5

ELECTROMAGNETIC RELAY

BACKGROUND OF THE INVENTION

1. Field of the Invention

This invention relates to an electromagnetic relay, and more particularly to the contact mechanism of the electromagnetic relay.

2. Discussion of the Prior Art

U.S. Pat. No. 4,618,842 discloses a conventional electromagnetic relay.

FIG. 6 is a schematic diagram showing a cross-section of the conventional electromagnetic relay. When a electromagnet portion 1 is excited, an armature 2 is swung so as to use one end portion of card 3. As a result, the card 3 pushes an upper end portion of a movable contact piece 4 and the movable contact piece 4 is then swung so that a movable contact 5 is switched over from one stationary contact 6 to the other stationary contact 7.

Upon deenergization of the electromagnet, the movable contact piece 4 returns by its own elastic force while pushing the card 3 so that the movable contact is switched over from one stationary contact 7 to the other 6.

Recently, the electromagnetic relay is required to be made compact and small in power consumption. However, it is difficult for such relays to provide a large drive force. In order to overcome this difficulty, the conventional electromagnetic relay is so designed that its movable contact piece 4 is made small in elastic force. As a result, the movable contact piece 4 is liable to be deformed by external force. In addition, when the movable contact piece 4 is externally vibrated or subjected to an impact during its returning operation, it is liable to be returned by the inertial forces of the armature 2 and the card 3. As a result, contact bounce may occur between the movable contact 5 and the stationary contact 6, thereby shorten service life. Sometimes, the movable contact may be brought into contact with the opposite stationary contact to cause malfunctions of the electromagnetic relay.

The above-described difficulty may be eliminated by coupling a coil spring to the armature, to prevent the armature from vibrating.

However, the method has the following disadvantages. The use of a coil spring increases the number of components and the number of manufacturing steps. The coil spring cannot be combined with the armature without providing a space in the relay, which makes it difficult to miniaturize the relay.

SUMMARY OF THE INVENTION

In view of the foregoing, an object of this invention is to provide an electromagnetic relay is small in size, low in power consumption, high in productivity, and long in service life, and operates with high accuracy.

The foregoing object and other objects of the invention have been achieved by the provision of an electromagnetic relay comprised of an armature swingably coupled to an electromagnet on the side of a magnetic pole of the electromagnet; a contact mechanism provided on the opposite side of the electromagnetic; and a card being slidably supported with both ends thereof coupled to the free end portion of the armature and a movable contact piece of the contact mechanism. The armature swings in association with energization and deenergization of the electromagnet to slide the card to drive the contact mechanism. According to the invention, the contact mechanism has a return spring near the movable contact piece. The return spring pushes an end of the card to urge the card in a return direction such that, when the card is returned, there is a small gap between the movable contact piece and the end of the card.

The nature, principle, and utility of the invention will be more clearly understood from the following detailed description of the invention when read in conjunction with the accompanying drawings.

BRIEF DESCRIPTION OF THE DRAWING(S)

In the accompanying drawings:

FIG. 2(*b*) is a plan view showing a movable contact piece and its relevant components in the electromagnetic relay of the invention;

FIG. 3 is a side view of a spool in the electromagnetic relay of the invention;

FIG. 4 is a side view of an electromagnet with an armature in the electromagnetic relay of the invention; and FIG. 5 is a front view, with one half in vertical section, of the electromagnet with the armature in the electromagnetic relay.

DETAILED DESCRIPTION OF THE INVENTION

Figure 1:
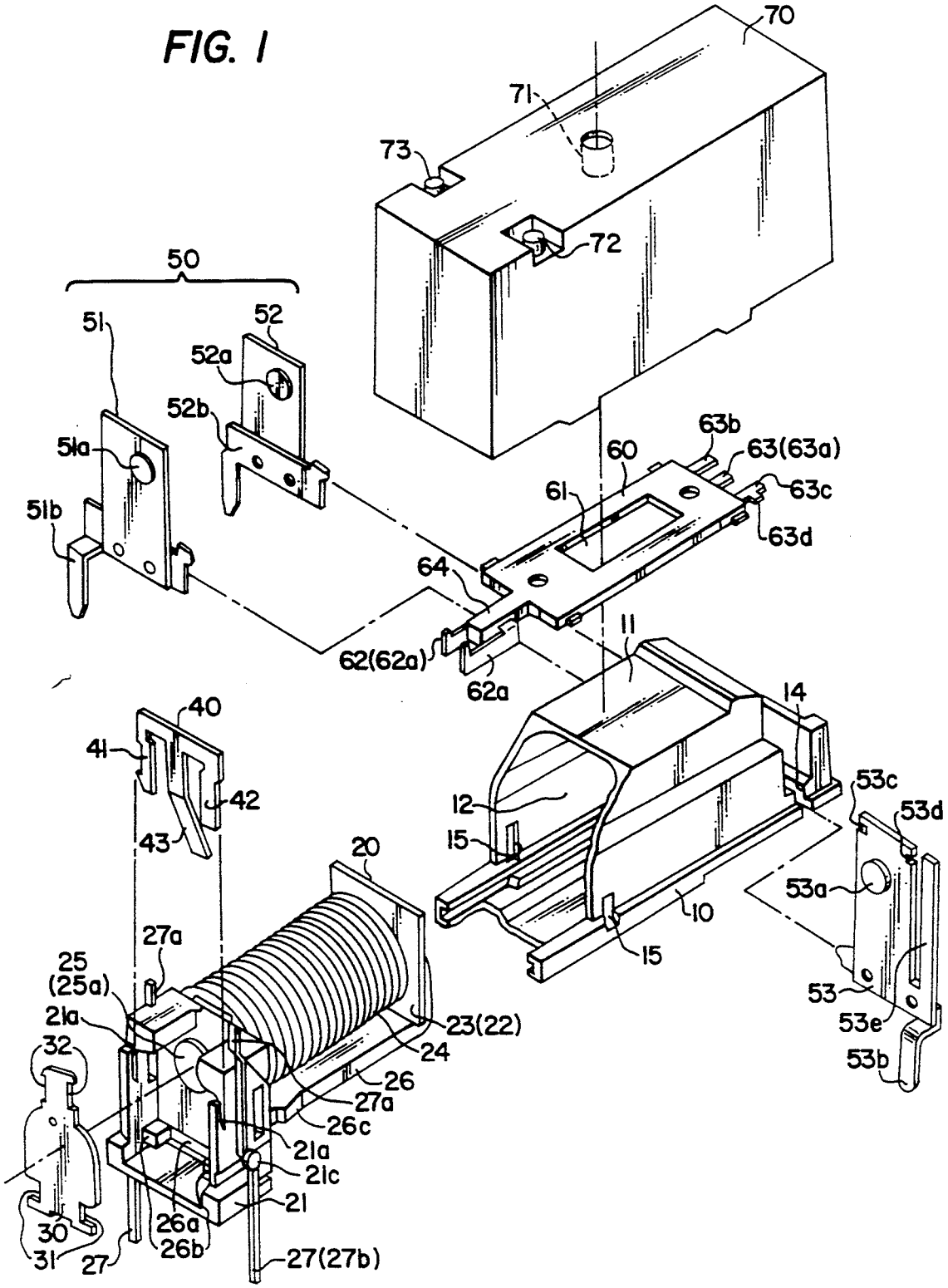
FIG. 1 is an exploded perspective view showing an example of an electromagnetic relay according to this invention.

An electromagnetic relay, which constitutes one embodiment of the invention, as shown in FIG. 1, comprises a base 10; an electromagnet 20 to which an armature 30 is coupled through a hinge spring 40; a contact mechanism 50; a slide card 60; and a casing 70.

Figure 2A:
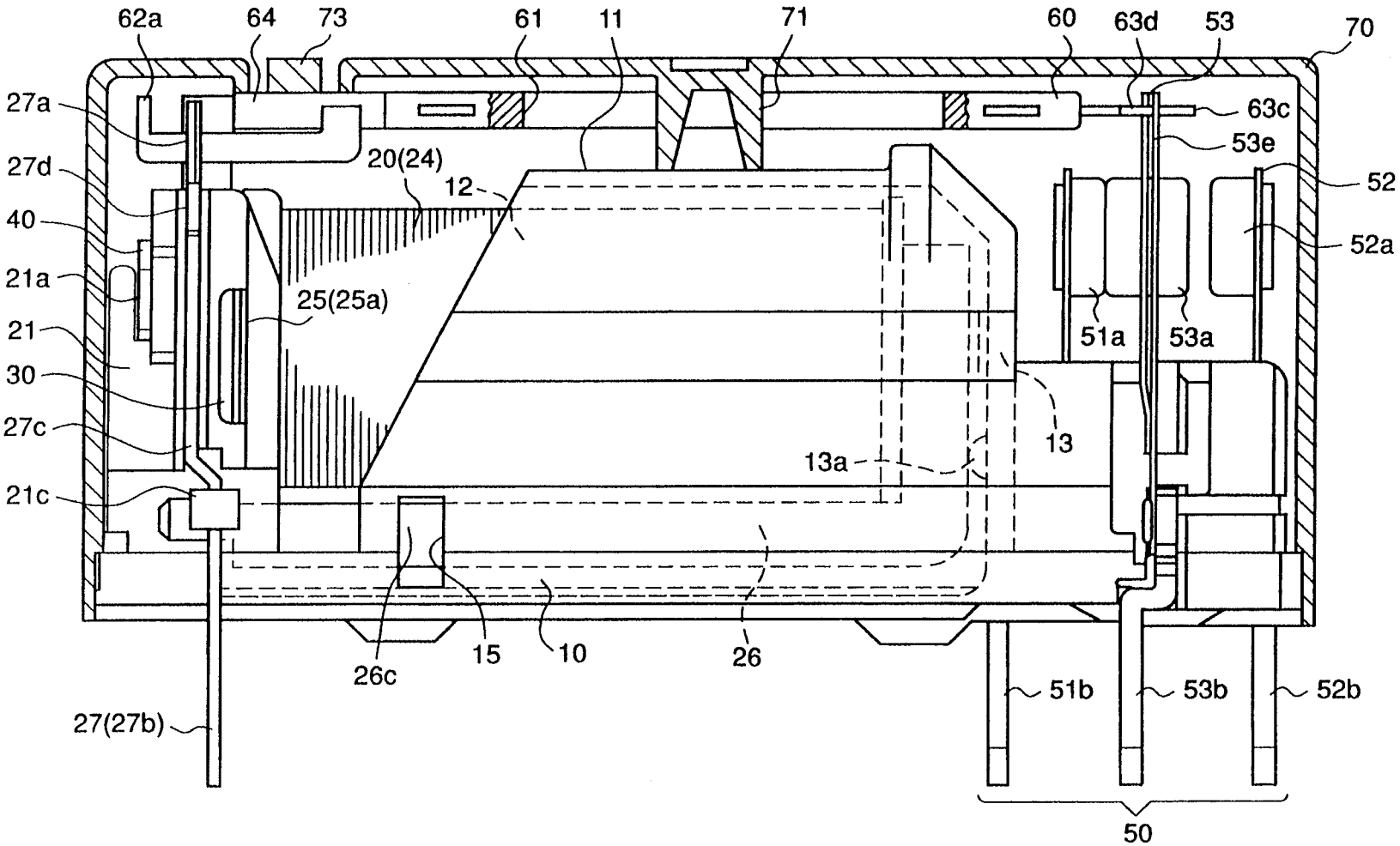
FIG. 2(*a*) is a longitudinal section view of the electromagnetic relay according to the invention.
Figure 6:
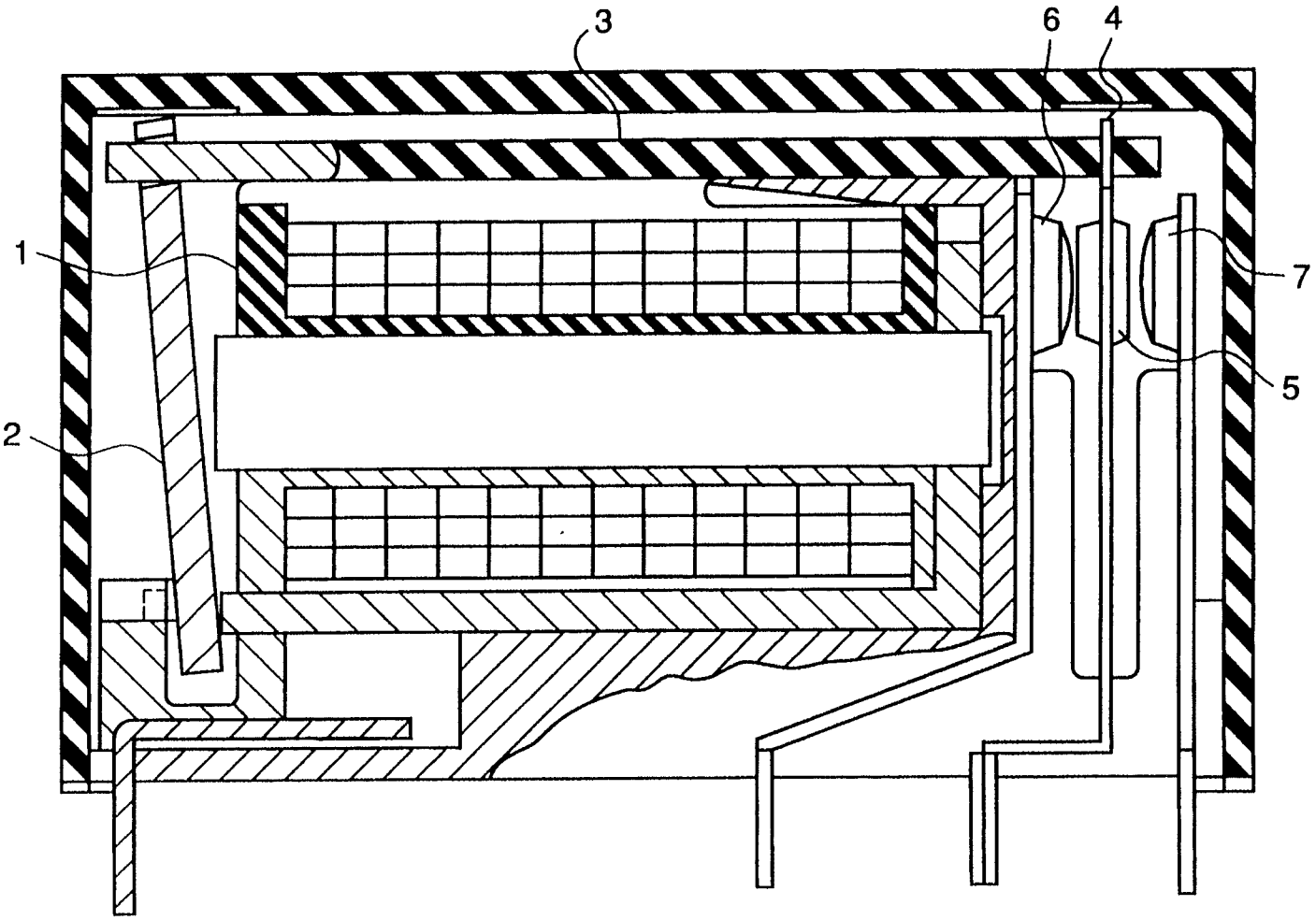
FIG. 6 (PRIOR ART)
FIG. 6 is a schematic diagram showing a cross section of a conventional electromagnetic relay.

A frame 11 U-shaped in section is integrally mounted on the base 10 at the middle, thus forming a cavity 12. The frame 11 includes an insulating wall 13, as shown in FIG. 2(*a*), which covers the deep end opening of the cavity 12. A positioning protrusion 13*a* is provided projectingly on the inner surface of the insulation wall 13. The base 10 has press-in grooves 14 outside the insulating wall 13 which are positioned alternately in a staggered manner (two press-in grooves 14 located in the back are not shown in FIG. 1). A movable contact piece 53 and stationary contact pieces 51 and 52, and the like, (described later) are fitted in the press-in grooves 14 from the side in order to form the contact mechanism 50. A pair of locking holes 15 and 15 is formed in both side walls of the frame 11 near the opening of the cavity 12.

The electromagnet 20 is formed as follows A coil 24 is wound on the barrel of a spool 23 which has flanges 21 and 22 at both ends. An iron core 25 with a substantially T-shaped section is inserted into a through-hole (not shown) formed in the barrel of the spool 23. One end portion appearing in the front surface of the flange 21 is used as a magnetic pole 25*a*. The other end portion which protrudes from the flange 22 is secured to the vertical portion of a substantially L-shaped yoke 26 by caulking.

As shown in FIG. 1, in the yoke 26, the positioning protrusion 26*b* and 26*b*, provided projectingly on both ends of a horizontal portion front end 26*a*, protrude from the front of the spool 23 of the flange 21. In addition, the horizontal portion of the yoke 26 has positioning pawls 26*c* (one of which is not shown) on both side faces.

As shown in FIG. 1, the flange 21 of the spool 23 has slits 21*a* and 21*a* at both side edge portions of its front surface in order to engage the hinge spring 40 (as described later), and coil terminals 27 and 27 are fixedly press-fitted in the outer surface of the side walls of the flange 21.

As shown in FIG. 3, each of the coil terminals 27 is made up of an upper end portion, namely, a winding portion 27*a*; a lower end portion, namely, a terminal portion 27*b*; and a middle portion 27*c* between those portions 27*a* and 27*b*. A protrusion, namely, a press-in portion 27*d*, is formed on the upper end of the middle portion 27*c* which merges with the winding portion 27*a*.

The coil terminals 27 are positioned as follows: The press-in portions 27*d* of the coil terminals 27 are press-fitted in press-in grooves 21*b* formed in the outer surfaces of the side walls of the flange 21, and parts of the middle portions 27*c* are press-fitted in between two pairs of caulking protrusions 21*c* and 21*c* which are formed on the outer surfaces of the side walls of the flange 21, respectively. Thereafter, the caulking protrusion 21*c* and 21*c* are deformed by hot or cold caulking, to fixedly secure the coil terminals 27.

Subsequently, the coil 24 is wound on the barrel of the spool 23, and its lead-out wires are wound on the winding portions 27*a* of the coil terminals 27, and soldered to them.

The coil terminals 27 may be fixed by other methods. For instance, the press-in portions 27*d* are formed on the lower ends of the middle portions 27*c*, and press-fitted in the press-in grooves, and the upper end portions of the middle portion 27*c* are fixed by caulking. Alternatively, the press-in portions 27*d* may be press-fitted fixedly by caulking. Furthermore, each of the middle portions 27*c* may be fixed as a whole, for instance, by hot-caulking.

As shown in FIG. 1, the armature 30 is in the form of a flat plate so that it can be attached to the central portion of the flange 21. The armature 30 has a pair of positioning notch portions 31 and 31 in the lower end portion at both ends, which are engageable with the positioning protrusions 26*b* and 26*b* of the yoke 26, respectively.

When the notch portions 31 and 31 are engaged with the positioning protrusions 26*b* and 26*b* of the yoke 26, as shown in FIG. 5, the armature 30 is confronted with the above-described magnetic pole 25*a* of the iron core 25, thus being movable into and out of engagement with the magnetic pole 25*a*.

The hinge spring 40 is made of a thin plate substantially E-shaped. When its right and left arms 41 and 42 are fixedly press fit in the slits 21*a* and 21*a* of the spool 23, the long tongue 43 depresses the lower end potion of the rear surface of the armature 30 so that the armature 30 is supported swingably like a hinge. The front end face 26*a* of the horizontal portion of the yoke 26 is a fulcrum for the armature.

When the electromagnet 20 which is coupled to the armature 30 through the hinge-spring 40, is inserted into the cavity 12 of the base 10 laterally, the vertical portion of the yoke 26 is abutted against the positioning protrusion 13*a* formed on the inner surface of the above-described insulating wall 13, while the positioning pawls 26*c* of the yoke 26 are locked to the locking holes 15 of the frame 11. Thus, the assembly of the electromagnet 20, the armature 30 ,and the hinge-spring 40 is fixedly secured to the base 10 with high accuracy. Hence, the resultant products are substantially uniform in operating characteristic, and can therefore be adjusted with ease.

In the electromagnetic relay of the invention, the hinge spring 40 is provided behind the lower portion of the armature 30 so that the dead space formed behind the armature 30 is effectively used. This constitution contributes to miniaturization of the electromagnetic relay.

The contact mechanism 50 comprises the pair of stationary contact pieces 51 and 52, and the movable contact piece 53. The stationary contacts 51*a* and 52*a* of the stationary contact pieces 51 and 52, and the movable contact 53*a* of the movable contact piece 53 are shifted a predetermined distance from the central axes, in widthwise direction, of the respective contact pieces. Hence, in addition to the bending moment, the twist moment is applied to the contacts 51*a*, 52*a*, and 53*a*. Therefore, the contacts are high in deposition resistance.

Furthermore, as described above, each of the contacts is shifted from the central axis of the respective contact piece. Hence, each of the contacts is longer in effective elastic length than one positioned on the central axis. Therefore, the thickness (or height) of the electromagnetic relay can be reduced as much.

The movable contact piece 53 has guides 53*c* and 53*d* above the movable contact 53*a*. The guides 53*c*, 53*d* are formed by cutting both side portions of the upper portion of the movable contact piece 53. The movable contact piece 53 is further provided with a return spring 53*e* extending along it. The base end portions of the movable contact piece 53 and the return spring 53*e* are fixedly secured to a terminal plate 53*b*, so that the movable contact piece 53 and the return spring 53*e* are able to operate independently of each other. The stationary contact pieces 51 and 52, the movable contact piece 53, and the return spring 53*e* are straight as shown in FIG. 1. However, the invention is not limited thereto or thereby. Therefore these pieces may be bent to account for economical use of material.

The terminal plates 51*b* and 52*b* of the stationary contact pieces 51 and 52, and the terminal plate 53*b* of the movable contact piece 53 are alternately press-fit in the press-in grooves 14 of the base 10. As a result the movable contact piece 53 is positioned between the stationary contact pieces 51 and 52.

According to this embodiment, since the stationary contact pieces 51 and 52 and the movable contact piece 53 are press-fit in the press-in grooves 14 and fixed there, the creeping distance between the terminal plates is long. Moreover, since each of the contact pieces may have a large width, even when large current is applied to the electromagnetic relay, the temperatures generated by the contact pieces are low and the contact pieces exhibit great elastic forces.

As shown in FIG. 1, the slide card 60 comprises a body which is a substantially rectangular flat plate made of synthetic resin. The slide card body has a rectangular engaging through-hole 61 at the center thereof, and locking metal parts 62 and 63 set in the body at both ends by insert-molding. At one side of the slide card 60, a driving protrusion 64 protrudes from the middle of one end face of the body of the slide card 60. The position regulating tongues 62*a* and 62*a* of the locking metal parts 62 protrude from the both sides of the driving protrusion.

On the other side of the slide card, the depressing tongue 63*a* of the locking metal part 63 protrudes from the middle of the side. Long tongues 63*b* and 63*c* are positioned at both sides of the depressing tongue 63*a* and protrude from the side. In addition, the long tongue 63*c* has a locking pawl 63*d* which extends laterally therefrom. Moreover, as shown in FIG. 2(*b*), when the slide card 60 is pushed in a return direction by the return spring 53*e*, a small gap is formed between the movable contact piece 53 and the depressing tongue 63*a*.

The slide card 60 is slidably supported as follows: The long tongues 63*b* and 63*c* of the slide card 60 are engaged with the guides 53*c* and 53*d* of the movable contact piece 53, respectively. In this operation, the depressing tongue 63*a* pushes the upper end of the movable contact piece 53 while the locking pawl 63*d* pushes the upper end of the return spring 53*e*. Under this condition, the position regulating tongues 62*a* and 62*a* are elastically engaged with the notches 32 and 32 from above.

In the electromagnetic relay of the invention, since the locking metal parts 62 and 63 are provided at both end portions of the slide card 60 by insert-molding, even if the movable contact piece 53 generates heat, the card 60 is hardly deformed or bent by the heat.

In addition, in the electromagnetic relay of the invention, even if the card 60 slides, since the card 60 is coupled through the locking metal parts 63 to the movable contact piece 53, wear powder is not generated from the resin parts of the card 60 and bad contact does not occur.

Furthermore, since the locking metal parts 63 have a high melting point, the card 60 is not softened by heat. The card can be assembled with ease which contributes to an improvement in productivity of the electromagnetic relay.

The casing 70 is like a box which is engageable with the base 10. The casing 70 has an annular protrusion 71, which is extends downwardly from the center of the inner ceiling of the casing 70. The casing 70 has a vent hole 72 and a protrusion 73 formed in the front portion of the top along the edges. The protrusion 73 is broken off to form a vent hole to release the nitric acid gas when nitric acid gas is formed inside the casing 70 during use.

When the casing 70 is mounted on the base 10 on which the internal assembly is mounted the protrusion 71 of the casing 70 is inserted into the through-hole 61 of the slide card 60 and abuts against the upper surface of the frame 11 of the base 10 as shown in FIG. 2(*a*). A sealing agent is injected to cover the bottom of the base 10, and solidified. Thereafter, the internal gas is removed through the vent hole 72, and which is closed by thermal melting. Thus, the assembling work has been accomplished.

According to this embodiment, the top of the casing 70 is maintained unchanged in position by the protrusion 71. Therefore, even when an external force is applied to the top of the casing 70, the top will not bend and thus will not interfere with the operation of the card 60.

When the casing 70 is molded, the gate of the metal mold should be set on the axis of the protrusion 71 of the casing 70 so that the molding resin flows well and the casing can be molded with high efficiency.

In the electromagnetic relay of the invention, the protrusion 71 of the casing 70 is abutted against the top of the frame 11 on the base 10. However, the invention is not limited thereto or thereby. For instance, the electromagnetic relay may be designed so that the protrusion 71 is abutted against the spool 23 of the electromagnet 20, or so that the protrusion is formed on the top of the frame 11 so that it is abutted against the top of the casing. On the other hand, instead of providing a through-hole 61, a notch may be formed in the slide card 60.

The operation of the electromagnetic relay thus constructed will be described.

When the electromagnet 10 is not excited yet, the card 60 is held a position while being urged in the left-handed direction in FIG. 2(*a*) by the elastic force of the return spring 53*e*, and the movable contact 53*a* is held in contact with the stationary contact 51*a* under a predetermined pressure.

When the electromagnet 10 is excited by the application of a voltage to the coil 24, the magnetic pole 25*a* of the iron core 25 attracts the armature 30 to swing the latter, so that the upper end portion of the armature 30 pushes the front end face of the protrusion 64 of the card 60. As a result, the card 60 is slid in the right-handed direction in FIG. 2(*a*), so that the locking pawl 63*d* of the card 60 pushes the upper end portion of the return spring 53*e*. The depressing tongue 63*a* then pushes the upper end portion of the movable contact piece 53. Thus, the return spring 53e and the movable contact piece 53 are swung in the stated order so that the movable contact 53*e* is tripped from the stationary contact 51*a* over to the stationary contact 52*a*.

When the electromagnet is deenergized, the slide card 60 is pushed back by the elastic force of the return spring 53*e* and the movable contact piece 53 so that the armature 30 is moved in the opposite direction to cause the movable contact 53*a* to trip from the stationary contact 52*a* over to the stationary contact 51*a*. After the movable contact 53 is held in contact with the stationary contact 51*a* under a predetermined pressure, the return spring 53*e* is restored pushing the card 60. When the return spring is restored, the gap is formed between the movable contact piece 53 and the depressing tongue 63*a* as shown in FIG. 2(*b*).

In the above-described electromagnetic relay, one movable contact is brought into contact with two stationary contacts alternately; however, the invention is not limited thereto or thereby. That is, it goes without saying that the technical concept of the invention may be applied to an electromagnetic relay in which one movable contact is moved into and out of engagement with one normally open or closed contact.

As was described above, when the movable contact piece is returned, the return spring provided beside the movable contact piece urges the card in the return direction when the card is returned. Hence, even if external vibration or impact is applied to the movable contact piece which is in the return mode, the displacement in the direction of movement of the card is regulated by the return spring. Hence, even when the movable contact piece is, for instance, vibrated, the movable contact piece does not work as long as the gap exits. Therefore, no contact bounce occurs. Therefore, the contacts have an increased service life, and the electromagnetic relay is prevented from erroneous operation.

In the electromagnetic relay of the invention, the return spring is integral with the movable contact piece. Therefore, in the electromagnetic relay of the invention, the number of components and the number of manufacturing steps are not increased, and productivity is high.

Furthermore, in the electromagnetic relay of the invention, the return spring extends from the movable contact piece. Hence, in the electromagnetic relay of this invention, unlike the conventional one in which the coil spring is additionally coupled, as a return spring, to the armature, it not necessary to provide an additional space for the return spring which aids in miniaturization of the electromagnetic relay.

In addition, the card hardly forms wear powder, and the contacts are therefore high in reliability. The gap is kept substantially uniform in dimension, and therefore the electro-magnetic relay is kept high in stability even when vibrated, for instance.

While a preferred embodiment of this invention has been described, it will be obvious to those skilled in the art that various changes and modifications may be made therein without departing from the invention, and it is intend, therefore, to cover in the appended claims all such changes and modifications as fall within the true spirit and scope of the invention.

What is claimed is:

1. An electromagnetic relay comprising:

an armature positioned so as to be capable of swinging in response to energization of an electromagnet and disposed on a side of said electromagnet;

a contact mechanism disposed on an opposite side of said electromagnet from said armature;

a card supported slidably with both ends of said card being coupled to a free end portion of said armature and a movable contact piece in said contact mechanism, said armature being swung to slide and return said card in order to drive said contact mechanism; and a elastic member which contacts of said card with a biasing force to urge said card in a return direction, said elastic member being disposed near said movable contact piece so that a small gap is formed between said movable contact piece and a part the end of said card, when said card is returned.

2. An electromagnetic relay as claimed in claim 1, wherein said return spring is formed integrally with a leaf spring material forming said movable contact piece.

3. An electromagnetic relay as claimed in claim 1, wherein said return spring is a slender spring which is provided beside said movable contact piece and substantially in parallel with said movable contact piece.

4. An electromagnetic relay comprising:

an armature positioned so as to be capable of swinging in response to energization of an electromagnet and disposed on a side of said electromagnet;

a contact mechanism disposed on an opposite side of said electromagnet from said armature;

a card supported slidably with both ends of said card being coupled to a free end portion of said armature and a movable contact piece in said contact mechanism, said armature being swung to slide and return said card in order to drive said contact mechanism; and a elastic member which contacts of said card with a biasing force to urge said card in a return direction, said elastic member being disposed near said movable contact piece so that a small gap is formed between said movable contact piece and a part the end of said card, when said card is returned, wherein said card is made of a resin and includes a first end portion adapted to push said return spring and a second end portion adapted to push said movable contact piece, said first and second end portions being provided by insert-molding a piece of metal plate in said card.

5. An electromagnetic relay comprising:

an armature positioned so as to be capable of swinging in response to energization of an electromagnet and disposed on a side of said electromagnet;

a contact mechanism disposed on an opposite side of said electromagnet from said armature;

a card supported slidably with both ends of said card being coupled to a free end portion of said armature and a movable contact piece in said contact mechanism, said armature being swung to slide and return said card in order to drive said contact mechanism; and a elastic member which contacts of said card with a biasing force to urge said card in a return direction, said elastic member being disposed near said movable contact piece so that a small gap is formed between said movable contact piece and a part the end of said card, when said card is returned, wherein said return spring is formed integrally with a leaf spring material forming said movable contact piece, and wherein said return spring and said movable contact piece are formed as one unit from an elastic plate, an end portion of said card is formed a plurality of pushing end faces made of a piece of metal plate for pushing said return spring and said elastic plate, and a length of at least one of said plurality of pushing end faces is different from length of the other pushing end face.

6. An electromagnetic relay as claimed in claim 2, wherein said return spring is a slender spring which is provided beside said movable contact piece and substantially in parallel with said movable contact piece.

7. An electromagnetic relay as claimed in claim 4, wherein said return spring and said movable contact piece are formed as one unit from an elastic plate, an end portion of said card is formed a plurality of pushing end faces made of a piece of metal plate for pushing said return spring and said elastic plate, and a length of at least one of said plurality of pushing end faces is different from length of the other pushing end face.

8. An electromagnetic relay as claimed in claim 1, further comprises a casing for casing said relay and a frame for covering said electromagnet.

9. An electromagnetic relay as claimed in claim 8, wherein said card has a through-hole.

10. An electromagnetic relay comprising:

an armature positioned so as to be capable of swinging in response to energization of an electromagnet and disposed on a side of said electromagnet;

a contact mechanism disposed on an opposite side of said electromagnet from said armature;

a card supported slidably with both ends of said card being coupled to a free end portion of said armature and a movable contact piece in said contact mechanism, said armature being swung to slide and return said card in order to drive said contact mechanism;

a elastic member which contacts of said card with a biasing force to urge said card in a return direction, said elastic member being disposed near said movable contact piece so that a small gap is formed between said movable contact piece and a part the end of said card, when said card is returned; and a casing for casing said relay and a frame for covering said electromagnet, wherein said casing has a protrusion extending downwardly from a center portion of an inner ceiling of said casing and said protrusion is inserted into said through-hole so that a lower end face of said protrusion is abutted against an upper surface of said frame.

11. An electromagnetic relay as claimed in claim 9, wherein a protrusion is formed on a top portion of said frame so that said protrusion is abutted against a top portion of said casing.

12. An electromagnetic relay as claimed in claim 8, wherein said casing has a protrusion extending downwardly from an inner ceiling of said casing and said protrusion is abutted against a spool of said electromagnet.

13. An electromagnetic relay as claimed in claim 8, wherein said card has a notch portion.

14. An electromagnetic relay as claimed in claim 13, wherein said casing has a protrusion extending downwardly from a center portion of an inner ceiling of said casing and said protrusion is passed through said notch portion so that a lower end face of said protrusion is abutted against an upper surface of said frame.

* * * * *